US006017031A

United States Patent [19]

Oosawa et al.

[11] Patent Number: 6,017,031

[45] Date of Patent: Jan. 25, 2000

[54] DOCUMENT FEEDER

[75] Inventors: Yukio Oosawa, Yamanashi; Masahiro Ogawa, Kohfu; Toshihiro Kubodera, Nirasaki, all of Japan

[73] Assignee: Nisca Corporation, Yamanashi, Japan

[21] Appl. No.: 08/779,668

[22] Filed: Jan. 7, 1997

[30] Foreign Application Priority Data

Jan. 22, 1996 [JP] Japan ..... 8-28604

[51] Int. Cl.[7] ..... B65H 3/52

[52] U.S. Cl. ..... 271/121; 271/124; 271/10.09; 271/161; 271/188

[58] Field of Search ..... 271/121, 125, 271/124, 10.09, 161, 188, 37

[56] References Cited

U.S. PATENT DOCUMENTS

| | | | |
|---|---|---|---|
| 4,015,839 | 4/1977 | McKee | 271/37 |
| 4,443,006 | 4/1984 | Hasegawa | 271/124 |
| 4,887,806 | 12/1989 | Tanaka et al. | 271/121 |
| 4,958,826 | 9/1990 | Chen | 271/124 |
| 5,052,676 | 10/1991 | Shiina et al. | 271/121 |
| 5,082,270 | 1/1992 | Kamezaki | 271/109 |
| 5,083,766 | 1/1992 | Osawa | 271/121 |
| 5,094,440 | 3/1992 | Matsuo et al. . | |
| 5,261,652 | 11/1993 | Kubo | 271/119 |
| 5,485,991 | 1/1996 | Hirano et al. | 271/121 |
| 5,537,227 | 7/1996 | Samii et al. | 358/498 |
| 5,575,467 | 11/1996 | Williams | 271/122 |
| 5,707,057 | 1/1998 | Oyama | 271/121 |

FOREIGN PATENT DOCUMENTS

| | | | |
|---|---|---|---|
| 2356602 | 6/1974 | Germany | 271/121 |
| 60-97137 | 5/1985 | Japan . | |
| 60-97138 | 5/1985 | Japan . | |
| 0244734 | 12/1985 | Japan | 271/121 |
| 0036246 | 2/1987 | Japan | 271/125 |
| 2-178133 | 7/1990 | Japan . | |
| 403088645 | 4/1991 | Japan | 271/121 |
| 404085227 | 3/1992 | Japan | 271/121 |

*Primary Examiner*—Christopher P. Ellis
*Assistant Examiner*—Steven B. McAllister
*Attorney, Agent, or Firm*—Kanesaka & Takeuchi

[57] ABSTRACT

A document feeder of the invention is formed of a sheet feeding tray for receiving sheets or documents thereon; a feeding device for feeding the sheets on the sheet feeding tray in order; and a feeding roller for feeding the sheets transferred from the feeding device in a sheet feeding direction and having at least one space extending in a direction perpendicular to the sheet feeding direction. The document feeder further includes at least first and second separating devices. The first separating device is formed of a frictional member having a frictional coefficient relative to a sheet greater than that between the sheets. The first separating device contacts the feeding roller and permits one sheet to pass therebetween. The second separating device is formed of an elastic member and has at least one tongue piece with a forward end. The forward end is located in the space of the feeding roller for separating the sheets between the forward end and the feeding roller. Therefore, when the sheets are separated, a back surface of the sheet is not smudged. Also, a misfeed or a double feed of the sheets does not take place, and separation of the sheets can be smoothly carried out.

18 Claims, 8 Drawing Sheets

DOCUMENT FEEDER

BACKGROUND OF THE INVENTION AND RELATED ART STATEMENT

The present invention relates to a document feeder having a separating device for separating and feeding a lowest sheet of stacked sheets or documents by rotatably contacting the lowest sheet, which is useful for automatically feeding the sheets or documents in a copying machine or facsimile machine.

As a prior art, there is an automatic document feeder K as a sheet feeding device including a sheet feeding roller for separating and feeding a lowest sheet of stacked sheets or documents mounted on a sheet feeding tray by rotatably contacting the lowest sheet, as shown in FIG. 11.

In the automatic document feeder K, the stacked documents or sheets are separated, and are fed one by one onto a platen P of a copier C. The automatic document feeder K is formed as follows.

In FIG. 11, a separating portion 125 for separating the stacked documents or sheets one by one and feeding thereof includes a sheet feeding roller 126 for feeding the separated sheet in a forward direction, and a separating member for preventing the document after the second sheet from being fed in the forward direction, which contacts the sheet feeding roller 126. The separating member is formed of a separating pad 127, and is made of a material having at least a large friction coefficient relative to the sheet so that a frictional force greater than that between the sheets acts between the separating pad and a document or sheet. The separating pad 127 is urged toward a side of the sheet feeding roller 126 by a holding spring 129 provided between a pad holder 128 and a spring holder 130.

Sheets or documents stacked on a sheet feeding tray 111 are fed as a batch of plural documents or sheets from a lower side by a pick-up roller 121 for constituting a feeding device together with a guide plate 113; the batch of sheets are passed through a front sweeping plate 114 and are guided to a separating portion 125 while forward ends thereof are being moved or separated diagonally; and only the lowest sheet is separated by the sheet feeding roller 126 of the separating portion 125 and the separating pad 127, and is fed to a reverse space portion 133. In the separating operation, when the batch of the sheets is fed by the pick-up roller 121, the batch of sheets is pressed from an upper side toward a down side with a weight plate 123 by means of a driving device, such as a solenoid which is not shown, so that a frictional force between the pick-up roller 121 and the batch of sheets is increased to thereby obtain a force for carrying the sheets to the sheet feeding roller 126.

A pressing action of the weight plate 123 continues until the batch of the sheets is nipped by the sheet feeding roller 126 and the separating pad 127, and thereafter it is released. The pressing action of the weight plate 123 increases a frictional force between the lowest sheet and the pick-up roller 121 as well as frictional forces among the sheets, which becomes an obstacle to the separating action by the separating portion 125. Thus, it is necessary that once the lowest sheet is nipped by the separating portion 125, the pressing action is released.

However, in the above-described conventional document feeder, since a relatively large number of documents or sheets enters into a space between the separating roller 126 and the separating pad 127 of the separating portion 125, there have been the following problems.

1. When the lower sheets of a batch of the stacked documents or sheets are subjected to a large friction force between the sheets due to a weight of the stacked documents or sheets, the lowest sheet and the second sheet thereon are forced to slide with a large friction force at the separating portion 125. Therefore, color of the characters or ink on a surface of the lowest sheet is transferred to a back surface of the second sheet thereon, so that the back surface of the second sheet is smudged, or the surface of the lowest sheet is smudged by being rubbed with the back surface of the second sheet. This phenomenon causes a problem in case manuscripts written by a pencil or a ball-point pen are handled in an automatic document feeder of a copying machine and facsimile machine.

2. Also, in case friction forces among lower sheets are large due to a weight of a batch of the stacked documents or sheets, a plurality of sheets or documents including the lowest sheet and other sheets piled thereon is apt to be fed at the same time by the pick-up roller 121. These sheets may enter, at the same time, a gate by the front sweeping plate 114 provided in front of the sheet feeding roller, or a space between the sheet feeding roller and the separating pad 127 which slidably contacts the sheet feeding roller for preventing sheets above the lowest sheet from being advanced, to thereby cause, what is called a wedge phenomenon, which results in a mis-feed or a double feed.

The present invention has been made to obviate the above problems, and an object of the invention is to provide a document feeder, wherein a back surface of a sheet or document is not smudged at a time of separation.

Another object of the invention is to provide a document feeder as stated above, wherein the mis-feed and double feed due to the wedge phenomenon does not occur, and the sheets or documents can be smoothly separated.

Further objects and advantages of the invention will be apparent from the following description of the invention.

SUMMARY OF THE INVENTION

In order to attain the above objects, the present invention has been made, as follows:

(1) A document feeder comprises a sheet feeding tray for receiving sheets or documents thereon, a feeding device for feeding the sheets on the tray in order, a sheet feeding roller for transferring the sheets from the feeding device to a sheet feeding or forward direction, and a first separating device formed of a frictional device and disposed to contact the sheet feeding roller. The frictional device has a friction coefficient relative to a sheet greater than that between the sheets, and prevents passage of more than one sheet. Namely, only one sheet passes. In the invention, the sheet feeding roller is formed of more than two roller members spaced apart from each other in the direction perpendicularly to the sheet feeding direction, and a second separating device formed of an elastic member having at least one tongue piece with a forward end located between the roller members is disposed in an upstream side of the sheet feeding direction relative to the first separating device.

Also, the tongue piece of the second separating device disposed between the two roller members has a semicircular shape having a diameter greater than the distance between the two roller members.

(2) A document feeder comprises a sheet feeding tray for receiving sheets or documents thereon, a feeding device for feeding the sheets on the tray in order, a sheet feeding roller for transferring the sheets from the feeding device to a sheet feeding or forward direction, and a first separating device formed of a frictional device and disposed to contact the sheet feeding roller. The frictional device has a friction coefficient relative to a sheet greater than that between the sheets and prevents passage of more than one sheet. Namely, only one sheet passes. In the invention, the sheet feeding roller includes at least one depression having a width in the direction perpendicularly to the sheet transfer direction, and a second separating device formed of an elastic member having at least one tongue piece with a forward end located in the depression is disposed in an upstream side of the sheet feeding direction relative to the first separating device.

Also, the tongue piece of the second separating device disposed in the depression of the sheet feeding roller has a semicircular shape having a diameter greater than the width of the depression of the sheet feeding roller.

(3) In the document feeder as disclosed in the feeder (1) or (2), the second separating device is formed of an elastic film member such that the elasticity at a portion spaced apart from the sheet feeding roller is less than that at the forward end thereof.

(4) In the document feeder as disclosed in the feeder (1) or (2), the second separating device further includes a restricting device for restricting elastic deformation of the elastic member.

In the document feeders as disclosed in the feeders (1) to (4), since the forward end of the tongue piece of the second separating device is located in the space between the roller members of the sheet feeding roller or the depression formed in the sheet feeding roller, when the sheets or documents pass through a space between the sheet feeding roller and the second separating device, the upper sheets receive a movement preventing force by engaging or contacting the forward end of the second separating device. Since the tongue piece at the forward end is located in the space between the roller members of the sheet feeding roller or the depression formed in the sheet feeding roller, the preventing force is greater than a situation where the tongue piece at the forward end is simply pressed against the surface of the roller. At this point, the sheets are moved or nearly separated and the lowest one or two sheets are fed.

As described above, since the one or two sheets moved laterally or separated by the second separating member are subjected to the final separating action by the first separating device, a friction force created between the sheets is smaller than that of plural sheets in the conventional document feeder. Therefore, smudge of the sheets or documents due to the movement or sliding of the sheets, i.e. ink on a surface of the first sheet or document is transferred onto the back surface of the second sheet or document while being rubbed together, or the characters on the surface of the first document becomes blur due to rubbing, does not occur so frequently. Also, it is effectively attained to prevent a double feed or non-feed of documents.

(5) In the document feeder as disclosed in the feeder (1) or (2), the second separating device is suspended to be swingable in the sheet feeding direction, and the center of gravity thereof is set such that the lower end of the second separating device is located in a direction away from the sheet feeding roller.

In the document feeder (5), when a sheet or document is jammed and a casing is released, the second separating device is separated from the sheet feeding roller automatically. Thus, the jammed sheet or document can be easily removed and a maintenance thereof can be easily carried out.

(6) In the document feeder as disclosed in the feeder (1) or (2), the first separating device is formed of a friction roller member provided with a torque limiter, and the torque limiter is set such that when the sheet to be fed between the friction roller member and the sheet feeding roller is one, the friction roller member is driven according to the rotation of the sheet feeding roller, and when the sheet to be fed is more than two sheets, rotation of the friction roller member is prevented.

In case of the apparatus (6), when more than two sheets are fed between the sheet feeding roller and the friction roller member, since sliding is formed between the sheets, the torque limiter does not work to thereby prevent the friction roller member from being rotated. However, in case the sheet fed between the sheet feeding roller and the friction roller member is only one sheet, since a force of the sheet feeding roller is transmitted to the friction roller member through the sheet, the torque limiter works and the friction roller member is subjected to be rotated. Therefore, even if the sheet is only one, the sheet is not rubbed between the sheet feeding roller and the friction roller member to thereby prevent the document from being smudged.

(7) In the document feeder as disclosed in the feeder (1) or (2), the feeder further includes a third separating device formed of a gap forming device disposed on a peripheral surface of the sheet feeding roller in the upstream side of the sheet feeding direction relative to the first and second separating devices. The third separating device prevents passage of more than the predetermined number of sheets.

(8) In the document feeder (7), the second separating device is attached to the third separating device.

In the document feeder (7) or (8), on the way to the second separating device, the sheets or documents are separated into a batch of plural sheets by the third separating device, and the upper side sheets receive a movement preventing force by contacting or engaging the forward end of the second separating device formed of the elastic member. Here, only the lowest one or two sheets are separated and fed. Therefore, smudge of the sheets or documents due to the movement or sliding of the sheets, i.e. ink on a surface of the first sheet or document is transferred onto the back surface of the second sheet or document while being rubbed together, or the characters on the surface of the first document become blur due to rubbing, does not occur so frequently. Also, it is effectively attained to prevent a double feed or non-feed of documents.

(9) A document feeder comprises a sheet feeding tray for receiving sheets or documents thereon, a feeding device for feeding the sheets on the tray in order, and a sheet feeding roller for transferring the sheets from the feeding device to a sheet feeding or forward direction. The feeding device includes a guide plate for guiding the sheets to the sheet feeding roller. The document feeder further includes a first separating device formed of a frictional member having a friction coefficient relative to a sheet greater than that between the sheets and preventing passage of more than one sheet; a second separating device formed of an elastic material and preventing forward movement of more than a predetermined number of sheets, the forward end of which slidably contacts the front edges of the sheets in the forward direction for sheet movement or separation; a third separating device for preventing passage of more than a predetermined number of sheets, which forms an inclination angle relative to an imaginary line parallel to a line extending from an upper surface of the guide plate; and a fourth separating device for preventing passage of more than a predetermined number of sheets, which forms an acute angle relative to an imaginary line parallel to the line extending from the upper surface of the guide plate, the inclination angle of the third separating device being greater than that of the fourth separating device. The first, second, third and fourth separating devices are arranged on the sheet feeding roller in the direction opposite to the sheet feeding direction.

(10) In the above document feeder (9), the sheet feeding roller is formed of more than two roller members spaced apart from each other in the direction perpendicular to the sheet feeding direction, and the second separating device is formed of an elastic film member having at least one tongue piece. The forward end of the tongue piece is located in a space between the roller members.

(11) In the above document feeder (9), the sheet feeding roller includes at least one depression having a width extending in the direction perpendicular to the sheet feeding direction, and the second separating device is formed of an elastic film member having at least one tongue piece. The forward end of the tongue piece is located in the depression.

In the document feeders (9) to (11), the sheets or documents on the sheet feeding tray is fed by the feeding device, such as a pickup roller or inclination of the sheet feeding tray, and transferred to the second separating device. On the way to the second separating device, the sheets are gradually separated to a small number of sheets by the fourth and third separating devices. Also, the upper sheets receive a movement preventing force by engaging or contacting the forward end of the second separating device formed of the elastic member. Thus, only one or two sheets are separated and transferred at this stage.

The one or two sheets separated by the second separating device are transferred to the first separating device, and only the lowest sheet is further transferred.

Accordingly, the document which is separated to one or two sheets by the second separating device is finally subjected to the separating operation by the first separating device. Therefore, the frictional force formed between the sheets is less than that of the plural sheets in the conventional document feeder. Therefore, smudge of the sheets or documents due to the movement or sliding of the sheets, which occurs such that ink on a surface of the first sheet or document is transferred onto the back surface of the second sheet or document while being rubbed together, or the characters on the surface of the first document become blur due to rubbing, does not occur so frequently. Also, it is effectively attained to prevent a double feed or non-feed of documents.

DETAILED DESCRIPTION OF PREFERRED EMBODIMENTS

Figure 1:
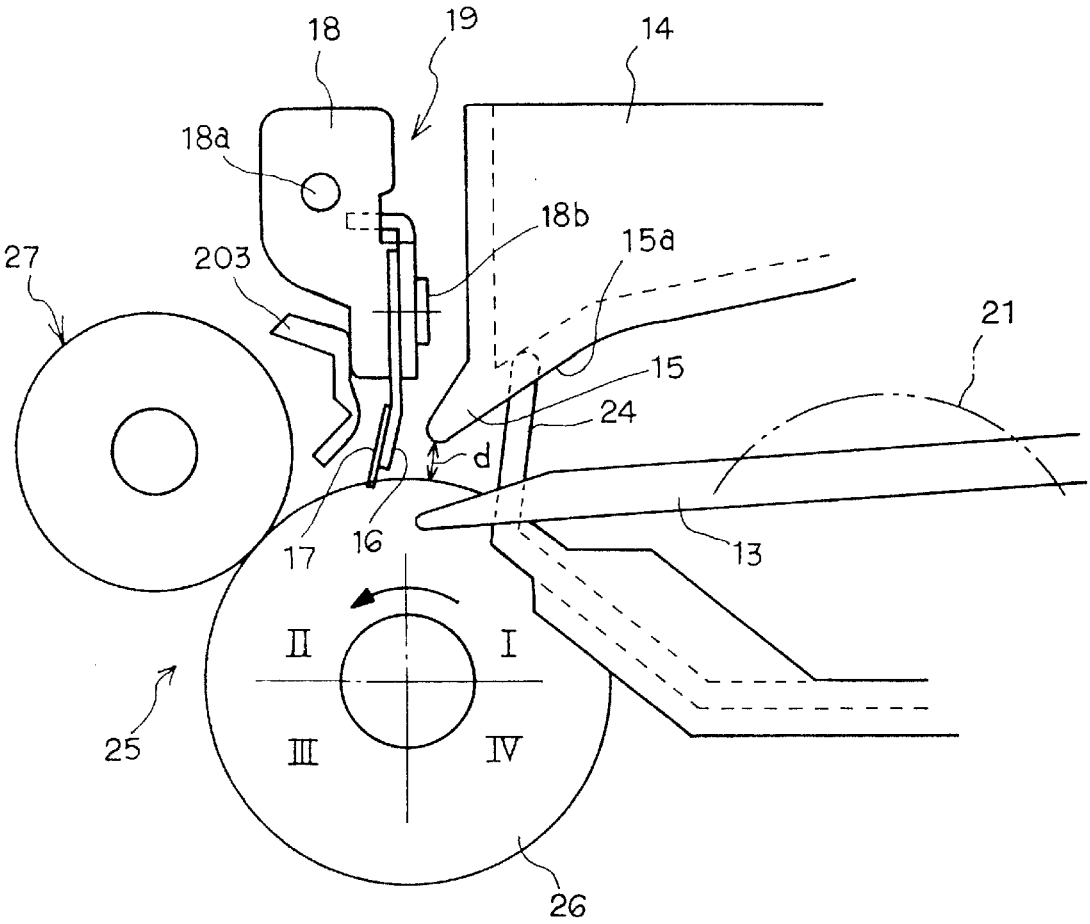
FIG. 1 is a diagram of an essential part of a document feeder according to the present invention.

The present invention is described hereunder referring to embodiments shown in the drawings.

Figure 2:
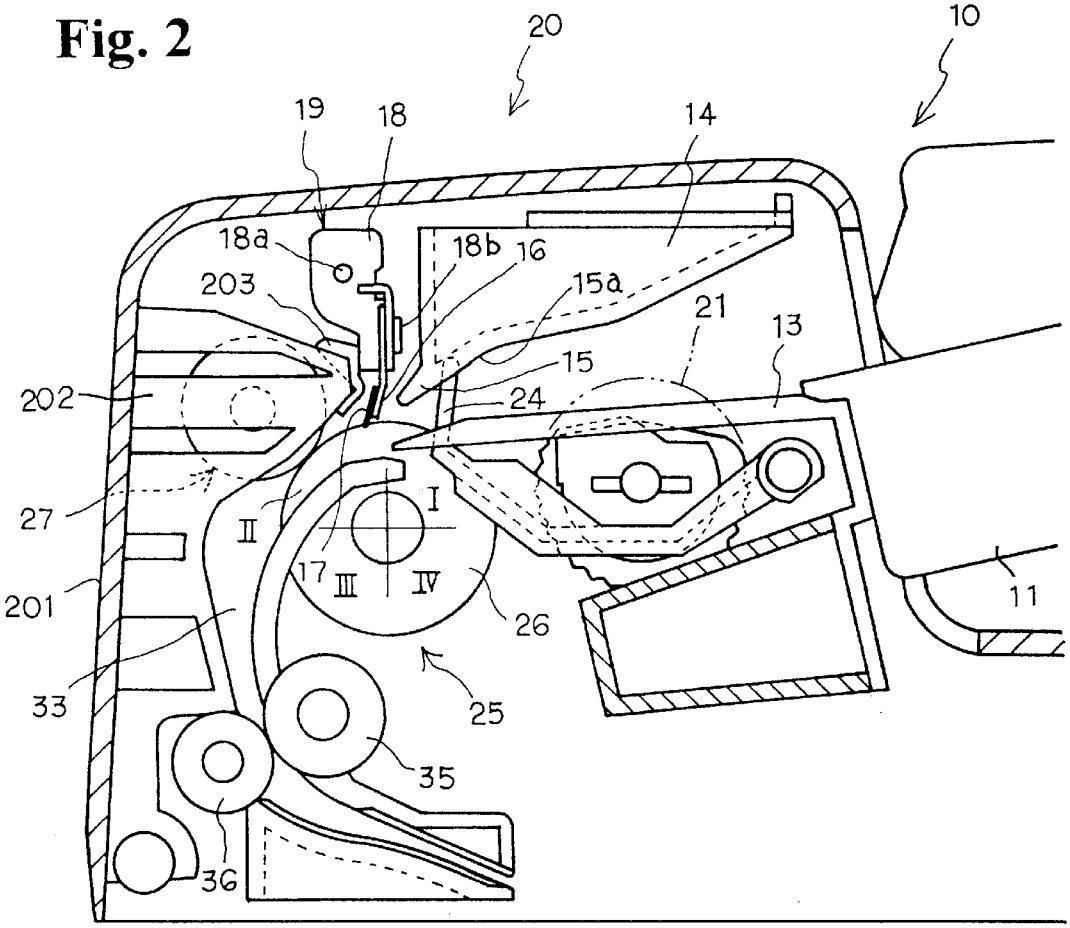
FIG. 2 is a diagram showing a sheet feeding portion of an automatic document feeder where the present invention is applied.
Figure 6:
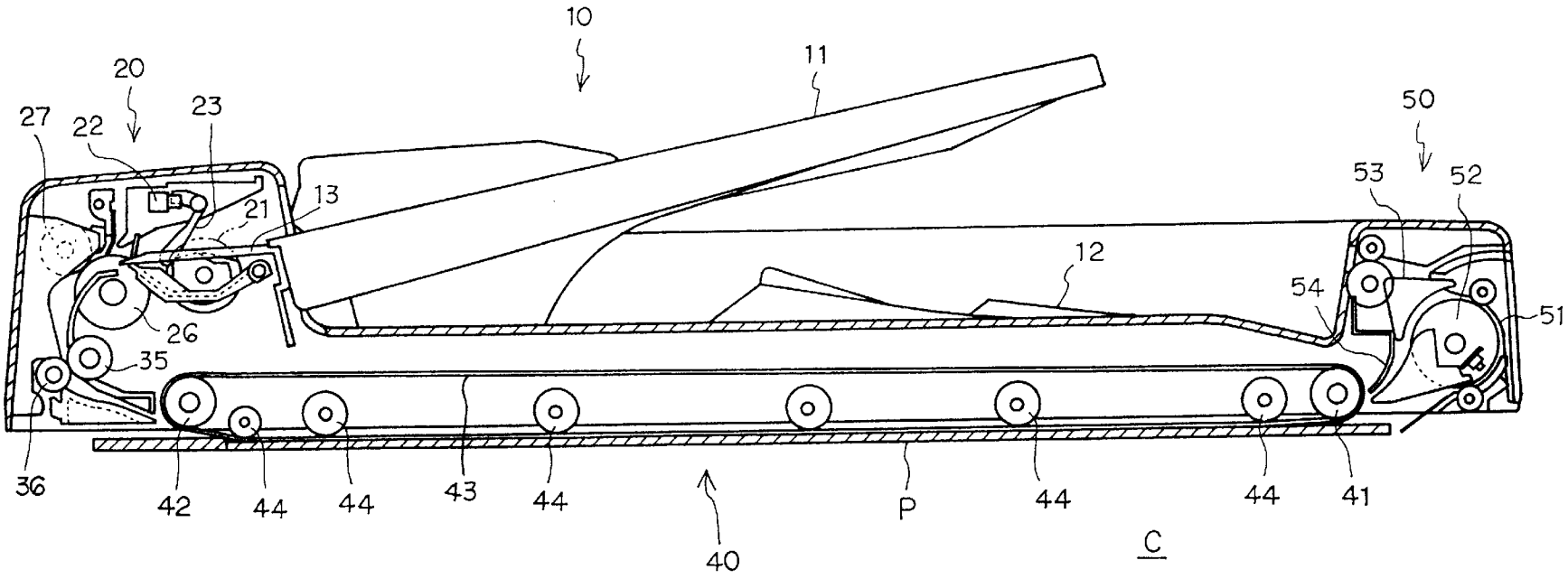
FIG. 6 is a diagram of an entire automatic document feeder of the present invention.

In FIGS. 2 and 6, reference numeral 10 represents an automatic document feeding apparatus of an electronic copier C, and a document feeder of the present invention is applied to a sheet feeding portion 20 thereof.

The automatic document feeding apparatus 10, as shown in FIG. 6, comprises a sheet feeding tray 11 on which sheets or documents are mounted; the sheet feeding portion (sheet feeding device) 20 for separating the sheets from the tray 11 one by one and feeding the sheets; a transfer portion 40 for receiving the sheet from the feeding portion 20 and transferring and positioning the sheet at a fixed position on a platen P of the copier C for an exposure processing; an ejecting portion 50 for ejecting the exposed sheet or document; and an ejected sheet tray 12 for accumulating the ejected sheets.

The transfer portion 40 includes a transfer belt 43 extending between a driving roller 41 and a driven roller 42, and a plurality of pinch rollers 44 is disposed inside the transfer belt 43.

The ejecting portion 50 comprises an ejecting roller 52 for transferring the sheet along an ejecting guide 51; a switching pawl 53 for reversely transferring the sheet in order to copy a back surface of the sheet; and a reverse feed guide 54 for guiding the reversely fed sheet or document.

The sheet feeding portion 20, as shown in FIGS. 1 and 2, includes a guide plate 13 for guiding a sheet or document from the sheet feeding tray 11 as a device for feeding the lowest sheet, and a semicircular pick-up roller 21 which orients upwardly through the guide plate 13 to contact the lowest sheet and rotates. Further, as shown in FIG. 6, an empty sensor 22 is provided in an upper portion of the pick-up roller 21 to detect absence of the sheet when an actuator 23 does not contact an upper most sheet.

Between the semicircular pick-up roller 21 and a sheet feeding roller 26 which is described later, there is provided a stopper 24, which temporarily stops the sheet by holding a forward edge thereof and is properly opened or closed by a solenoid, not shown. The stopper 24 is moved upwardly from under the guide plate 13 in the vicinity of an intersection of the guide plate 13 and the sheet feeding roller 26. In case the sheet feeding roller 26 is divided into sectors I, II, III and IV, each of which has a 90 degree area, as shown in FIG. 1, the intersection of the guide plate 13 and the sheet feeding roller 26 is located in an upper part and an upper stream side of the sector, i.e. sector I, in a sheet feeding or forward direction of the sheet feeding roller 26. In other words, a forward edge portion of the guide plate 13 is extended on a side of the first sector I of the sheet feeding roller 26.

Reference numeral 25 represents a separation-feed portion for separating and feeding the sheets one by one. The separation-feed portion 25 includes the sheet feeding roller 26 as a feeding device for feeding the sheet or document in the sheet feeding direction, and a separating roller 27 (first separating device) contacting the sheet feeding roller 26 and preventing the second or more sheets from being advanced in the forward direction.

Figure 3:
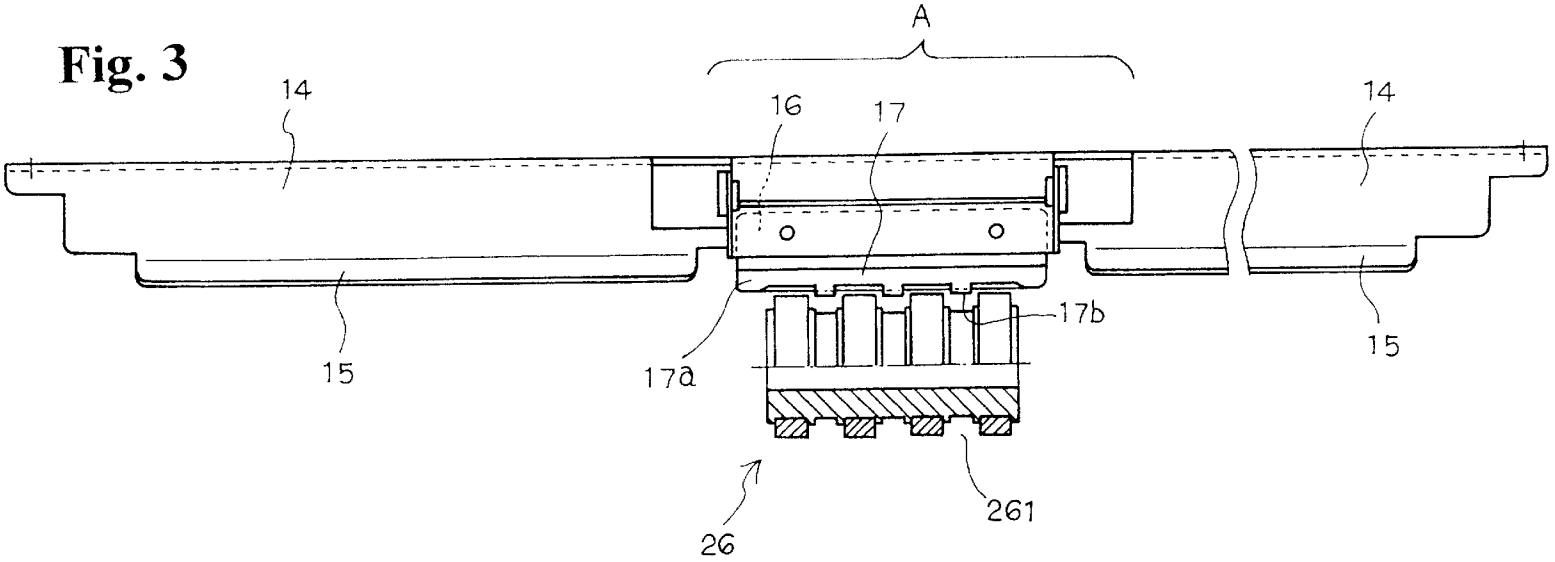
FIG. 3 is a view showing a relationship between a feeding roller and a gap forming member.

The sheet feeding roller 26, as shown in FIG. 3, is formed of a plurality of rollers provided around the same axis with a predetermined space therebetween, and top portions of the circumferences of the rollers are located to be slightly higher than an imaginary line extending from a top surface of the guide plate 13.

The separating roller 27 is provided with a torque limiter, and is disposed on the sheet feeding roller 26 to contact therewith such that the separating roller 27 is located at a downstream side of the sheet feeding roller 26 in the forward direction, i.e. within 90 degrees from the vertical line passing through the center of the sheet feeding roller 26. In other words, the separating roller 27 is located in the sector II on the downstream side in an upper half portion of the sheet feeding roller 26.

The separating roller 27 is made of a material having a large friction coefficient relative to the sheet so that the separating roller 27 acts on the sheet with at least a frictional force larger than that between the sheets. The torque limiter provided to the separating roller 27 is set such that the separating roller 27 rotates according to the rotation of the sheet feeding roller 26 when one sheet enters between the separating roller 27 and the sheet feeding roller 26, and the rotation of the separating roller 27 is prevented when more than two sheets enter between the separating roller 27 and the sheet feeding roller 26.

In the middle from the feeding devices 13, 21 to the separating roller 27, i.e. around the sheet feeding roller 26 in the sector I, there is provided a gap forming member 14 (fourth separating device) having a forward edge 15 with a predetermined space d with respect to the circumferential surface of the sheet feeding roller 26. The gap forming member 14 extends to substantially an entire width of the sheet which passes therethrough except a part of a central area A, as shown in FIG. 3. An inner and upstream side surface 15*a* of the forward edge 15 of the gap forming member 14 is inclined with an angle of about 30 degrees with respect to a horizontal surface, and an imaginary line extending from the inner surface 15*a* crosses the top portion of the sheet feeding roller 26.

Around the sheet feeding roller 26 between the gap forming member 14 and the separating roller 27 and on the downstream side of the sheet feeding direction of the gap forming member 14, i.e. in the second sector II, a gap forming member 16 formed of a plate member having rigidity is provided with a space relative to the sheet feeding roller 26, which is narrower than the space d. Also, around the sheet feeding roller 26 between the gap forming member 16 and the separating roller 27 and on the downstream side of the sheet feeding direction of the gap forming member 16, there is provided an elastic film member 17 in a thin plate, such as Mylar.

The gap forming member 16 and the elastic film member 17, as shown in FIG. 3, extend over the central area A of the width of the passing sheet where the gap forming member 14 is not formed. An upper base portion of the elastic film member 17 is laminated with the gap forming member 16 and is integrally connected thereto. At a forward end 17*a* of the elastic film member 17, as shown in FIG. 3, tongue pieces 17*b* are formed, and the tongue pieces 17*b* are inserted into recesses 261 of the sheet feeding roller 26 to about 0.5 mm from each of the forward ends in a state where the forward ends 17*a* are inclined, which is described later.

Figure 7:
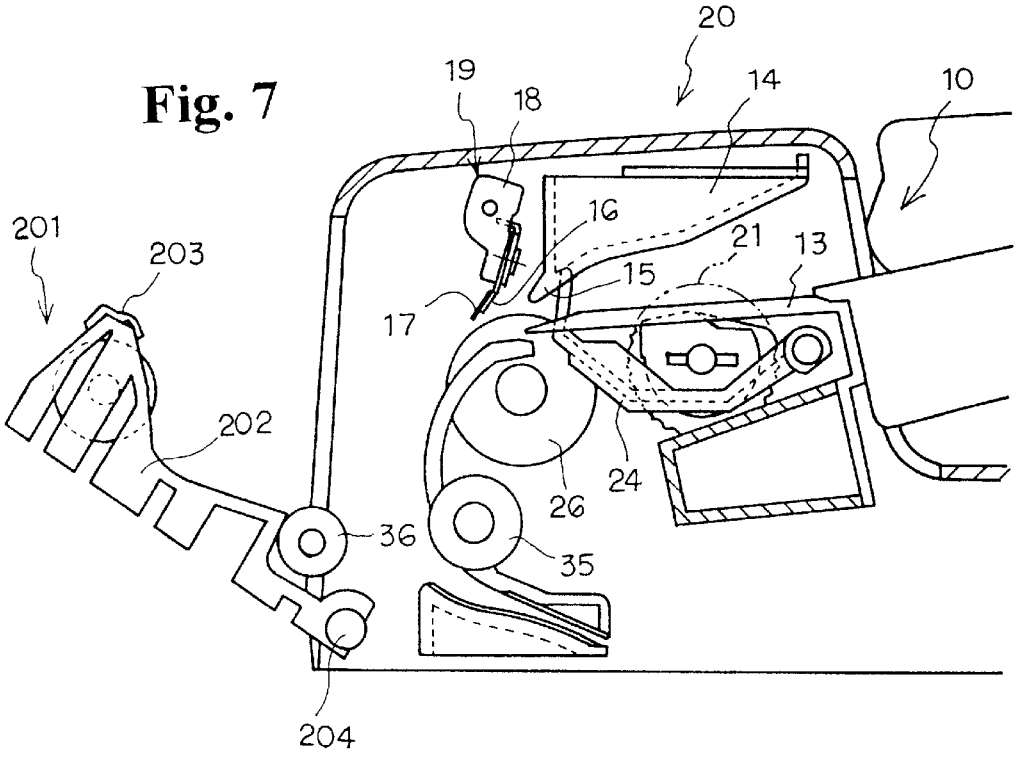
FIG. 7 is a diagram for showing the automatic document feeder to which the present invention is applied, wherein a casing of a sheet feeding portion is opened.

The gap forming member 16 with the elastic film member 17 is fixed by screws 18*b* to a swinging piece 18 which is swingable around a shaft 18*a* provided to a fixed frame of a casing. In particular, an assembly 19 including the gap forming member 16 and the elastic film member 17 is suspended from the shaft 18*a* to be swingable in the sheet feeding direction, wherein a center of the gravity of the whole assembly 19 is set such that if a support is not present, the lower ends of the gap forming member 16 and the elastic film member 17 are moved and separated from the surface of the sheet feeding roller 26 and positioned at a non-active position with an inclination, as shown in FIG. 7.

As a supporting device for pressing the assembly 19 at the nonactive position to a predetermined active position, an inner frame 202 having a projection is provided to an opening-closing lid portion 201 in a register portion of a casing of the sheet feeding portion, and an upper end 203 with a pad as the projection abuts against the swinging piece 18 to thereby press and return the assembly 19. Thus, normally, the second gap forming member 16 is located at the active position as shown in FIGS. 1 and 2.

In order to prevent a forward end portion of a sheet or document from being folded or bent, the forward end 17*a* (see FIG. 1) of the elastic film member 17 is inclined toward the downstream side in the sheet feeding direction with respect to the vertical center line of the sheet feeding roller 26. In this inclined condition, the tongue pieces 17*b* are slightly inserted into the recesses 261 between the roller portions of the sheet feeding roller 26.

Next, a function and operation of the present invention are explained.

When documents or sheets are placed on the sheet feeding tray 11 and the copier C is started, the pick-up roller 21 starts feeding lower sheets toward the separation-feed portion 25 along the guide plate 13. At this time, a solenoid, not shown, of the stopper 24 also starts operating to thereby lower the stopper 24 downwardly.

The batch of the documents or sheets stacked on the sheet feeding tray 11 is fed in association with the rotation of the pick-up roller 21 by a friction force between the sheet and the pick-up roller 21 due to pressure. The batch of sheets or documents, first, is separated to few sheets from a lower side thereof and is fed through the gate opening with the predetermined opening d at the lower portion of the forward end 15, while being separated and aligned obliquely at their forward ends due to a barrier action of the inner side surface 15*a* of the forward end 15 of the first gap-forming member 14; and is then guided to the gap forming member 16 and the elastic film member 17.

Since the forward end of the gap forming member 16 is separated from the circumferential surface of the sheet feeding roller 26 with a narrower space than the predetermined space d of the gap forming member 14, the batch of sheets is separated to further fewer sheets. Then, the batch of the few sheets passes under the flexible elastic film member 17 inserted into the recesses 261 of the sheet feeding roller portions and having the forward ends formed at the tongue pieces. Since the tongue pieces 17*b* at the forward end of the elastic film member 17 are located in the recesses 261, when the sheets pass between the sheet feeding roller 26 and the elastic film member 17, the upper sheets are caught by the forward ends of the elastic film member 17 and receive a force for preventing a forward movement. Since the force is created by the tongue pieces 17*b* entering into the recesses 261, the force is greater than a force with which the elastic film member is simply pressed against the surface of the sheet feeding roller. Moreover, at this stage, since the number of the sheets is reduced by having passed through the gap forming member 14 and the gap forming member 16, a pressure of the upper part sheets applied to the lowest sheet is small. Therefore, an additional sheet separating action is carried out without creating a great friction force between the lowest sheet and the sheets thereon, and only the lowest one or two sheets are separated and fed.

The one or two sheets separated at the elastic film member 17 are guided to the sheet feeding roller 26 and the separating roller 27, and only the lowest sheet is separated by the sheet feeding roller 26 and the separating roller 27 and is fed to a space 33 (see FIG. 2). Incidentally, the sheet separated and fed to the space 33 gradually changes its direction and advances along a guide surface formed on an inner side of the frame 202 to abut against the register roller 35. After a loop or curved portion of the sheet is formed by rotation of the sheet feeding roller 26 to adjust the posture of the sheet, the sheet, a latter half of which is held by the separation-feed portion 25, is fed by the register roller 35 and a pinch roller 36.

As described hereinabove, since one or two sheets separated by the gap forming member 14, the gap forming member 16 and the elastic film member 17 are subjected to a final separating action by the sheet feeding roller and the separating roller, a friction force created by a sheet or sheets is smaller than that created in a conventional batch of plural sheets or documents. Therefore, even if the first sheet and the second sheet are subjected to a shifting or sliding action by the sheet feeding roller 26 and separating roller 27, smudge of the sheets or documents, i.e. ink on a surface of the first sheet is transferred to a back surface of the second sheet while the first sheet is rubbed against the second sheet, or characters on the surface of the first sheet are rubbed to blur, is presented. Also, at the same time, it is effectively attained to prevent a double feed or non-feed of sheets.

Further, since the separating roller 27 is provided with a torque limiter, when the document fed between the separating roller 27 and the sheet feeding roller 26 is one sheet, the rotational force of the sheet feeding roller 26 is transmitted to the separating roller 27 through the sheet. Thus, the torque limiter is activated and the separating roller 27 is driven according to the rotation of the sheet feeding roller 26, so that the sheet is permitted to pass therebetween. Thus, even if the sheet or document is one, the sheet is not rubbed between the separating roller 27 and the sheet feeding roller 26 to thereby prevent the document from being smudged. In case two or more sheets are present between the separating roller 27 and the sheet feeding roller 26, since a sliding movement is created between the sheets, the torque limiter is not activated to thereby allow the separating roller 27 to rotate. Therefore, two sheets are effectively separated.

Also, since the elastic film member 17 made of Mylar is integrally provided to the gap forming member 16, the elastic film member 17 is firmly supported. Also, the gap forming member 16 and the elastic film member are easily disposed at a relatively narrow space between the gap forming member 14 and the separating roller 27, so that two separating functions can be added.

Figure 4:
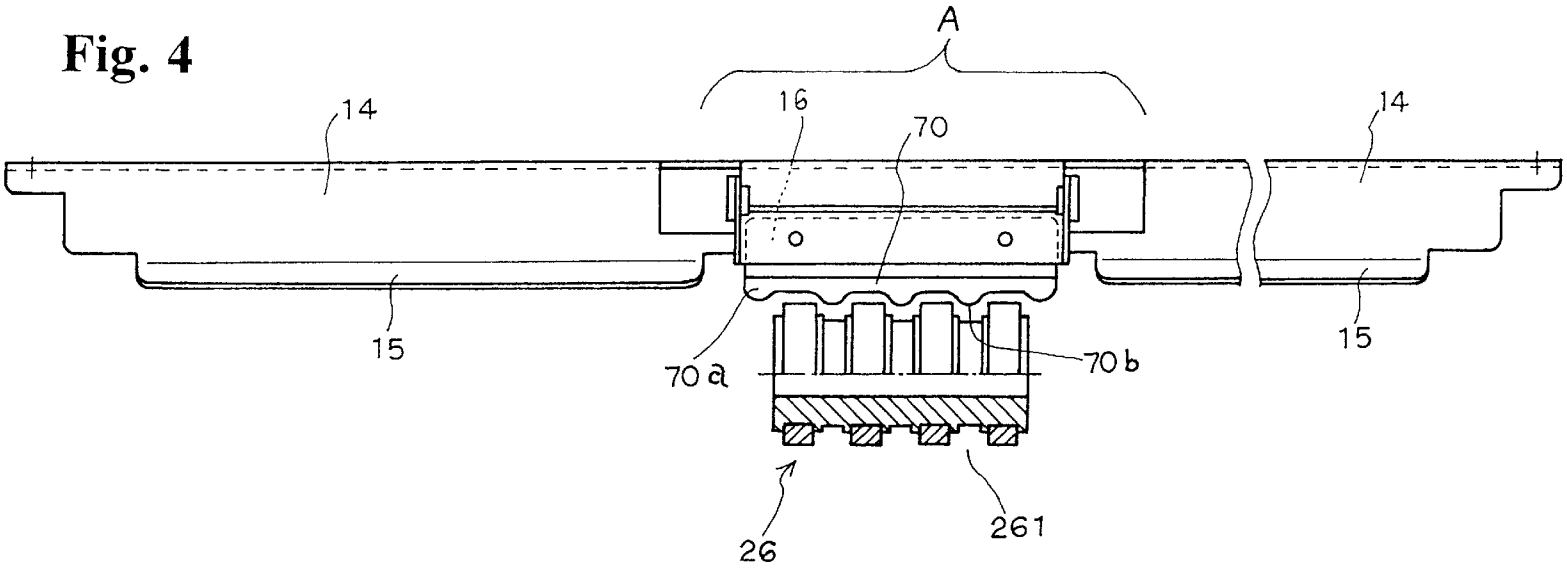
FIG. 4 is a view for showing tongue pieces of an elastic film member in a semicircular shape as shown in FIG. 3.

As shown in FIG. 4, each of tongue pieces 70*b* of an elastic film member 70 may be formed to have a semicircular shape, a diameter of which is greater than a distance between the roller members of the sheet feeding roller 26 (length of the depression 261). Since the tongue piece 70*b* of the elastic film member 70 is formed to have a semicircular shape, elasticity of the tongue piece 70*b* becomes gradually large toward the tip thereof. Thus, the sheet can be smoothly entered between the elastic film member 70 and spaces or depressions, each being surrounded by the roller members of the sheet feeding roller 26. Also, after the sheet is entered, it can prevent the excessive deformation of the sheet, and the damage of the front end of the sheet when the sheet is entered between the sheet feeding roller 26 and the elastic film member 70 is reduced.

Figure 5B:
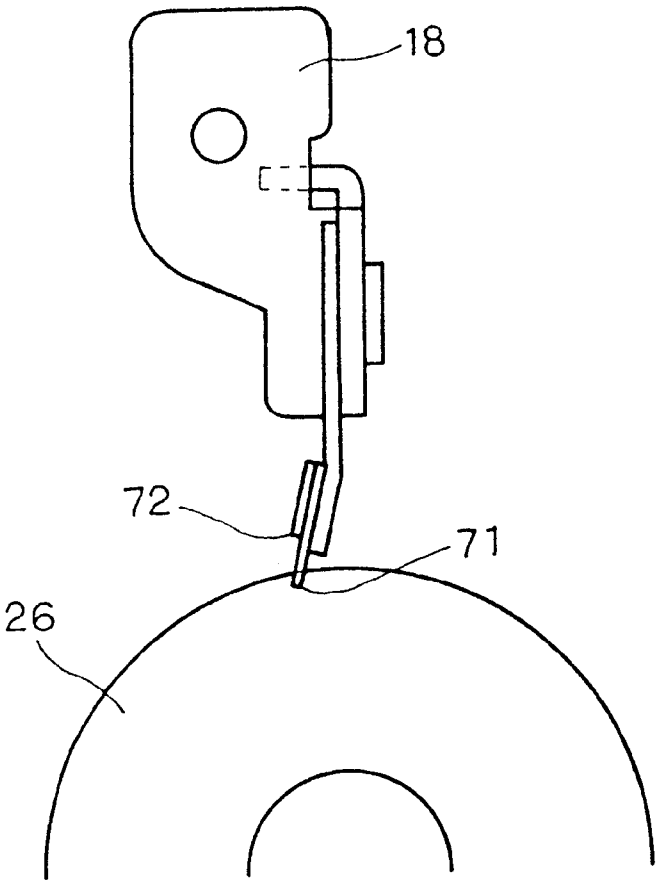
FIGS. 5(*a*) and 5(*b*) are views for showing a device for lowering elasticity of a predetermined part of the elastic film member.
Figure 5A:
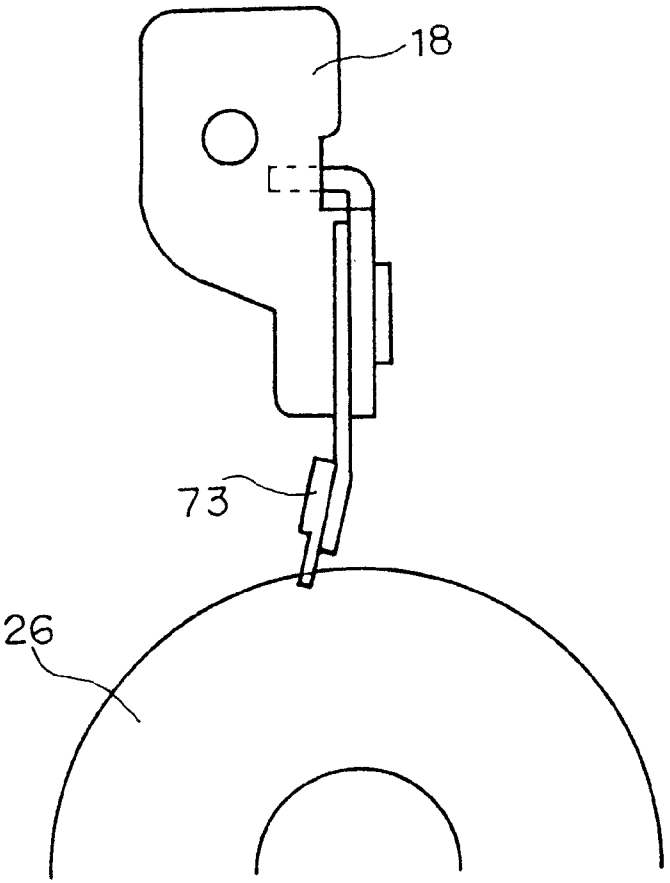

Also, the elastic film member 17 or 70 should not lose the sheet preventing operation by excessive deformation when the sheet passes. Thus, it is preferable to reduce elasticity of the elastic film member from a portion slightly away from the surface of the sheet feeding roller 26. As a device for reducing elasticity of the elastic film member, the thickness of an elastic sheet member 73 may be partly increased (FIG. 5(*a*)), or an additional film 72 may be mounted on an elastic film member 71 (FIG. 5(*b*)).

When a sheet or document is jammed at the sheet feeding portion 20, the opening-closing lid portion 201 of the casing of the sheet feeding portion is opened from an upper side with a pivotal shaft 204 as a center, as shown in FIG. 7. Accordingly, the separating roller 27 and the pinch roller 36 mounted on the frame 202 of the opening-closing lid portion 201 can be separated from the mating sheet feeding roller 26 and register roller 35, respectively. At this time, the upper end portion 203 with the pad of the frame 202 is also separated from the swinging piece 18. Thus, the whole assembly 19 is rotated from an active position shown in FIG. 2 to an inactive position shown in FIG. 7 due to inclination of a center of gravity, so that the gap forming member 16 and the elastic film member 17 are automatically separated from the sheet feeding roller 26.

Therefore, by only opening the opening-closing lid portion 201 of the casing of the sheet feeding portion, the document jammed at the sheet feeding portion can be easily removed. Also, maintenance at the sheet feeding portion 20 can be easily carried out.

Incidentally, the sheet feeding roller is not limited to the example described above. For example, there may be employed a roller provided with more than one recess around its circumference in sheet feeding direction.

Also, in the above embodiment, although a batch of sheets or documents is guided to the elastic film member while the sheets are gradually separated by the two gap forming members, there may be employed a structure such that either one of the two gap forming members may be provided to separate the batch of the sheets to guide the sheets to the elastic film member.

Figure 8:
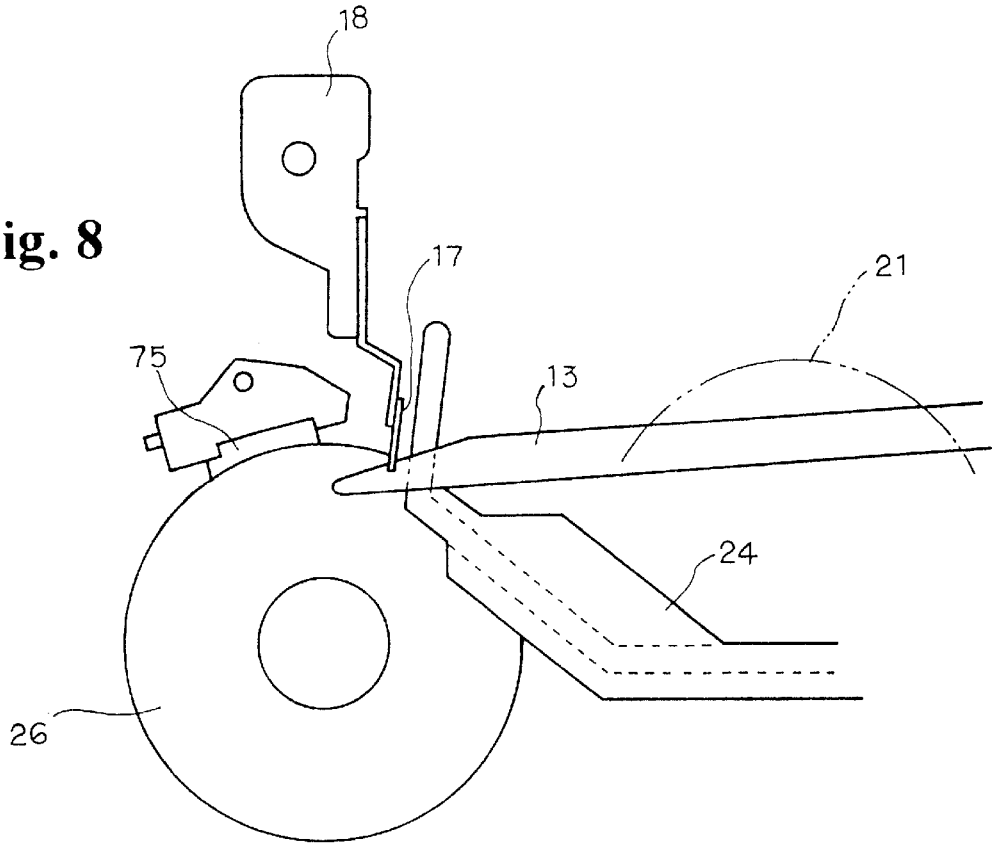
FIG. 8 is a diagram of an essential part of a document feeder showing another embodiment of the invention.
Figure 9:
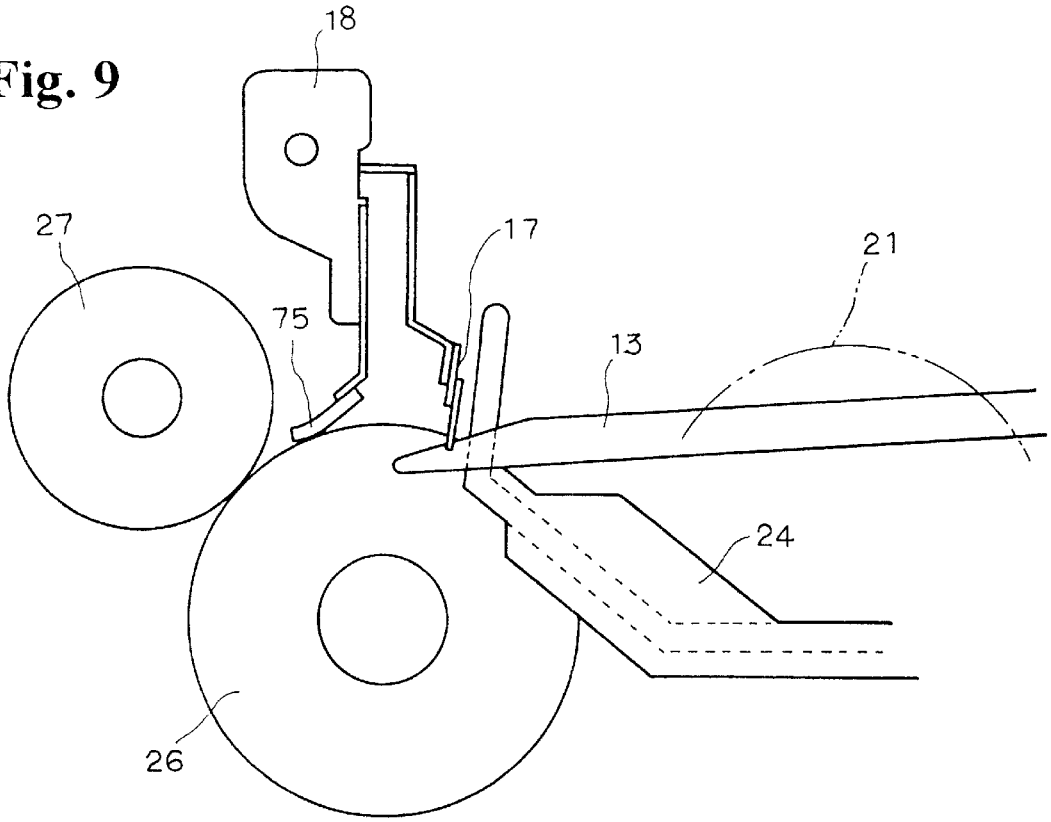
FIG. 9 is a diagram of an essential part of a document feeder showing a different embodiment of the invention.

In the above embodiment, a separating device for separating only the lowest sheet from one or two sheets separated by the elastic film member is the separating roller 27. However as shown in FIG. 8, the separating device may be formed of a separating pad 75 formed of an elastic rubber member instead of the separating roller 27. Also, as shown in FIG. 9, the separating roller 27 and separating pad 75 may be formed to securely separate the sheets.

Figure 10:
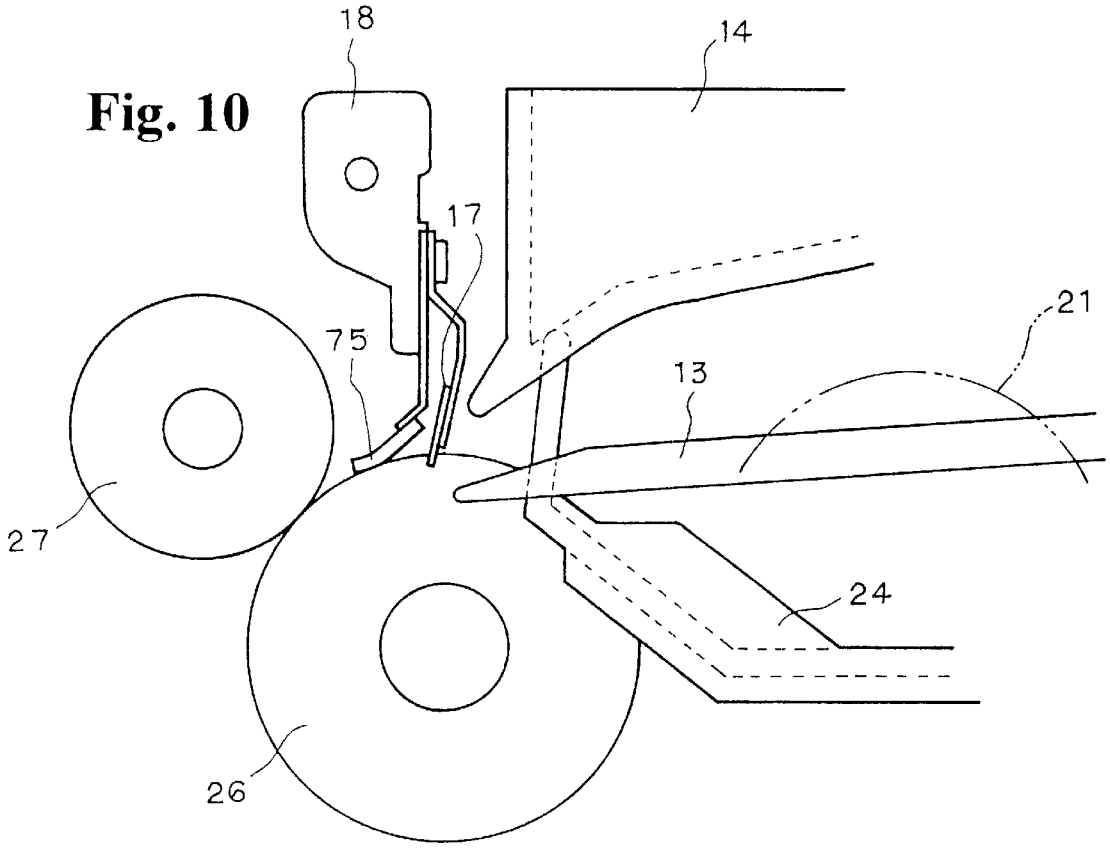
FIG. 10 is a diagram of an essential part of a document feeder showing a still different embodiment of the invention.
Figure 11:
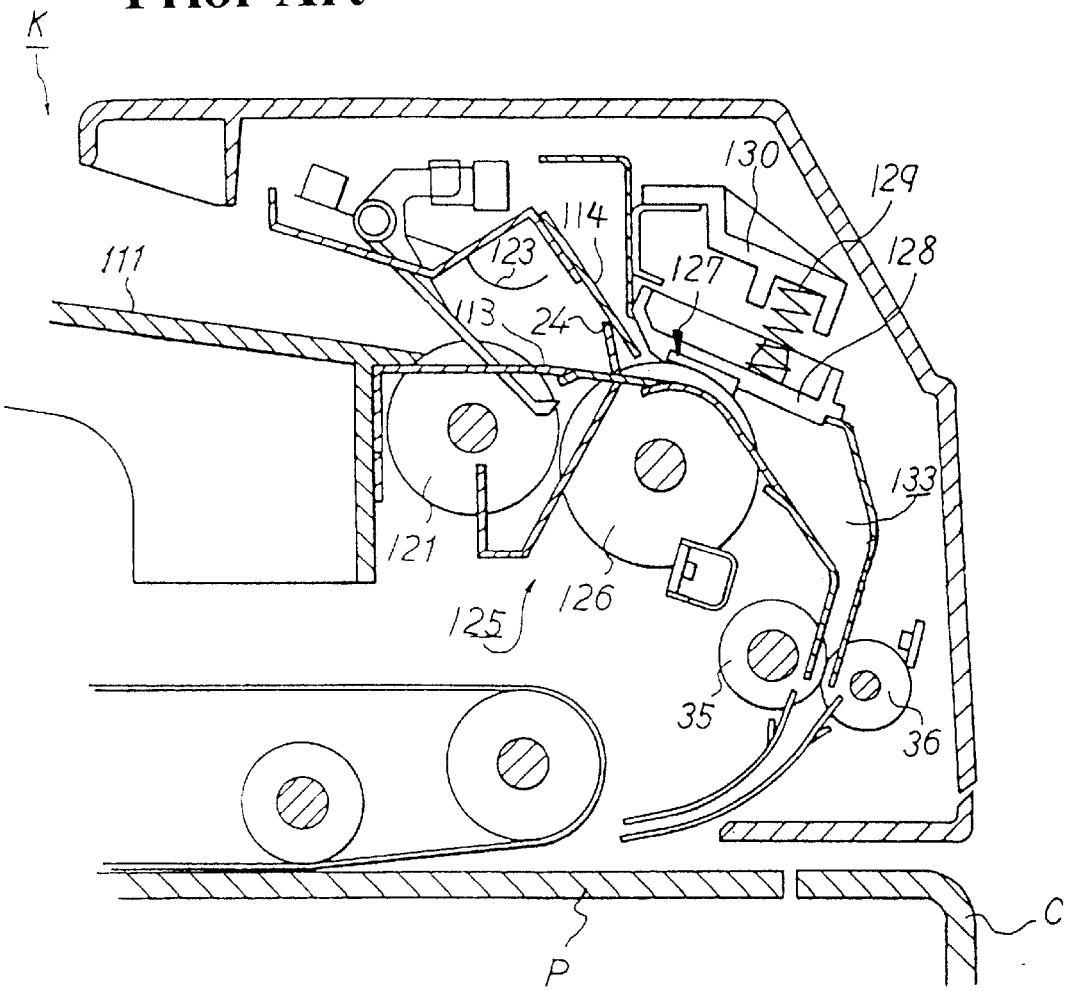
Fig. 11 Prior Art
FIG. 11 is a vertical sectional view of a sheet feeding portion of a conventional automatic document feeder.

As shown in FIG. 10, it is possible to arrange the two gap forming members, elastic film member, separating pad and separating roller around the sheet feeding roller.

According to the present invention, the following effects can be obtained.

(1) Since the forward ends of the tongue pieces of the elastic film member are located between the spaces of the roller members of the sheet feeding roller or the recesses or depressions formed in the sheet feeding roller, when one or more sheets pass between the sheet feeding roller and the separating roller or separating pad, the upper sheet receives a movement restricting force by engaging or contacting the forward ends of the elastic film member. Since the forward ends of the tongue pieces are located in the spaces of the roller members of the sheet feeding roller or the depressions formed in the sheet feeding roller, the restricting force is great when compared with a situation that the forward ends are simply urged on a roller surface. Therefore, in this section, the sheets are nearly separated again, and only one or two sheets are transferred in the forward direction.

As described above, since the sheets separated into one or two by the elastic film member are subjected to a final separating action, a friction force created between the sheets is smaller than that of the plural documents in a conventional document feeder. Therefore, smudge of the sheets or documents due to the movement or sliding of the sheets, i.e. ink on a surface of the first sheet is transferred onto the back surface of the second sheet while being rubbed together, or the characters on the surface of the first sheet becomes blur due to rubbing, does not occur so frequently. Also, it is effectively attained to prevent a double feed or non-feed of documents.

(2) When the case is opened at the time of sheet jam, since the elastic film member is automatically separated from the separating roller, the jammed sheet can be easily removed, and maintenance can also be easily carried out.

(3) In case two or more sheets enter between the sheet feeding roller and the separating roller, slipping takes place between the sheets, so that the torque limiter is not activated to thereby prevent rotation of the separating roller. However, in case only one sheet enters between the sheet feeding roller and the separating roller, a force of the sheet feeding roller is transmitted to the separating roller through the sheet to thereby actuate the torque limiter. Thus, the separating roller is rotated according to the sheet feeding roller. Accordingly, even if only one sheet is present, the sheet is not rubbed between the sheet feeding roller and the separating roller to thereby prevent the sheet or document from being smudged.

(4) On the way to the elastic film member, the sheets are separated into several sheets, and further, upper sheets receive a movement preventing force by engaging or contacting the forward ends of the elastic film member. Thus, the lower one or two sheets are separated and transferred forwardly, and by the first separating means, only the lowest sheet is transferred. Therefore, the smudge of the sheets or documents due to the movement or sliding of the sheets, i.e. ink on a surface of the first sheet is transferred onto the back surface of the second sheet while being rubbed together, or the characters on the surface of the first sheet becomes blur due to rubbing, is reduced. Also, a double feed or non-feed of the sheet is effectively prevented.

(5) The sheets mounted on a sheet feeding tray are fed by the feeding device, for example, a pick-up roller or an inclination of the sheet feeding tray, and guided to the elastic film member. On the way to the elastic film member, the sheets are separated into the plural sheets by the two gap forming members, and the upper sheets receive the movement preventing force by engaging the forward end of the elastic film member. At this point, only one or two sheets are separated and fed.

The one or two sheets separated by the elastic film member are guided to the separating roller or frictional pad, and only the lowest sheet is separated by the separating roller or frictional pad.

As described hereinabove, since one or two sheets separated by the elastic film member are subjected to a final separating action, a friction force created between the sheets is smaller than that of the plural sheets in a conventional case. Therefore, the smudge of the sheets or documents due to the movement or sliding of the sheets, i.e. ink on a surface of the first sheet is transferred onto the back surface of the second sheet while being rubbed together, or the characters on the surface of the first sheet becomes blur due to rubbing, is reduced. Also, a double feed or non-feed of the sheet is effectively prevented.

While the invention has been explained with reference to the specific embodiments of the invention, the explanation is illustrative and the invention is limited only by the appended claims.

What is claimed is:

1. A document feeder comprising:

a sheet feeding tray for receiving sheets thereon;

feeding means for feeding the sheets on the sheet feeding tray in order and having a guide plate;

a feeding roller for feeding the sheets transferred from the feeding means in a sheet feeding direction, said feeding roller having at least one annular space having a width extending in a direction perpendicular to the sheet feeding direction;

a first separating device formed of a friction member having a friction coefficient relative to one of the sheets greater than that between the sheets, said first separating device contacting the feeding roller and permitting one sheet to pass between the first separating device and the feeding roller;

a second separating device situated near the first separating device at an upstream side of the sheet feeding direction, said second separating device being formed of an elastic member inclined at a first acute angle relative to an imaginary line parallel to a line extending from an upper surface of the guide plate and having at least one tongue piece with a forward end, said forward end being located in the space of the feeding roller for separating the sheets between the forward end and the feeding roller; and a third separating device located above the feeding roller and spaced away from the second separating device at the upstream side of the sheet feeding direction, said third separating orienting downwardly toward the feeding roller to separate the sheets together with the feeding roller, said third separating device being spaced from the feeding roller and inclined at a second acute angle relative to the imaginary line parallel to the line extending from the upper surface of the guide plate, said second acute angle being less than the first acute angle to gradually reduce a number of the sheets to pass from the third separating device to the first separating device.

2. A document feeder according to claim 1, wherein said tongue piece of the second separating device is located in the space of the feeding roller and is formed to have a semicircular shape, a diameter of which is greater than a width of the space.

3. A document feeder according to claim 2, wherein said feeding roller is formed of more than two roller members, said space being formed between the two roller members.

4. A document feeder according to claim 2, wherein said feeding roller is formed of one roller, said space being dented radially inwardly from a surface of the one roller to form a depression.

5. A document feeder according to claim 1, wherein said second separating device is formed of an elastic film member such that elasticity at a side away from the sheet feeding roller is less than that at the forward end.

6. A document feeder according to claim 1, wherein said second separating device includes an elasticity reducing device at a side away from the forward end.

7. A document feeder according to claim 1, wherein said second separating device is arranged to be swingable in the sheet feeding direction, a center of gravity of the swingable second separating device being in a position such that the forward end is moved away from the separating roller.

8. A document feeder according to claim 1, wherein said first separating device is formed of a friction roller member having a torque limiter, said torque limiter being set such that when one sheet enters between said friction roller member and the sheet feeding roller, the friction roller member rotates according to the rotation of the sheet feeding roller, and when at least two sheets enter therebetween, rotation of the friction roller member is prevented.

9. A document feeder according to claim 1, further comprising a fourth separating device formed of a gap forming member for preventing more than a predetermined number of the sheets from passing therethrough, said fourth separating device being disposed on a peripheral surface of the sheet feeding roller at an upstream side of the sheet feeding direction relative to the first and second separating devices.

10. A document feeder according to claim 9, wherein said second separating device is formed of an elastic film member such that elasticity at a side away from the sheet feeding roller is less than that at the forward end, said elastic film member being attached to the fourth separating device.

11. A document feeder according to claim 1, wherein said elastic member orients downwardly toward the feeding roller so that the forward end of the elastic member is located in the space, and a forward end of the third separating device is spaced outwardly from an outer surface of the feeding roller.

12. A document feeder according to claim 11, wherein said second separating device is located in a central area of the feeder perpendicular to the sheet feeding direction, and the third separating device is located at side portions outside the central area.

13. A document feeder according to claim 12, wherein said feeding roller is located only in the central area.

14. A document feeder comprising:

a sheet feeding tray for receiving sheets thereon;

feeding means for feeding the sheets on the sheet feeding tray in order and having a guide plate;

a feeding roller for feeding the sheets transferred from the feeding means along the guide plate in a sheet feeding direction;

a first separating device formed of a frictional member having a frictional coefficient relative to one of the sheets greater than that between the sheets, said first separating device permitting one sheet to pass therethrough;

a second separating device formed of an elastic member having a forward end, said forward end contacting forward edges of the sheets in the sheet feeding direction to separate the sheets and prevent more than a predetermined number of the sheets from advancing forwardly;

a third separating device for preventing more than a predetermined number of the sheets from passing therethrough, said third separating device forming an inclined surface relative to an imaginary line parallel to a line extending from an upper surface of the guide plate; and a fourth separating device located above the feeding roller and for preventing more than a predetermined number of sheets from passing therethrough, said fourth separating device being spaced from the third separating device and forming an inclined surface with an acute angle relative to an imaginary line parallel to a line extending from the upper surface of the guide plate, said inclined surface of the fourth separating device being less in angle than that of the third separating device, said first, second, third and fourth separating devices facing the feeding roller for separating the sheets and being arranged in order in a direction opposite to the sheet feeding direction to reduce a number of sheets passing therethrough along the sheet feeding direction.

15. A document feeder according to claim 14, wherein said sheet feeding roller is formed of more than two roller members spaced in a direction perpendicular to the sheet feeding direction to have a space therebetween, said second separating device being formed of an elastic film member having at least one tongue piece with the forward end, said forward end being disposed in the space.

16. A document feeder according to claim 14, wherein said sheet feeding roller is formed of one roller having a depression having a width in a direction perpendicular to the sheet feeding direction, said second separating device being formed of an elastic film having at least one tongue piece with the forward end, said forward end being disposed in the depression.

17. A document feeder according to claim 14, wherein said first separating device contacts an outer surface of the feeding roller, a forward end of said elastic member being located close to the feeding roller, and said third and fourth separating device being spaced from the outer surface of the feeding roller so that a forward end of the third separating device is located closer to the feeding roller than that of the fourth separating device.

18. A document feeder according to claim 17, wherein said second and third separating devices are disposed parallel to each other.

* * * * *